US005437949A

United States Patent [19]

Kanbayashi et al.

[11] Patent Number: 5,437,949

[45] Date of Patent: Aug. 1, 1995

[54] COLOR TONER AND PROCESS FOR ITS PRODUCTION

[75] Inventors: Makoto Kanbayashi; Tsuyoshi Takiguchi, Kawasaki; Wakashi Iida, Higashikurume, all of Japan

[73] Assignee: Canon Kabushiki Kaisha, Tokyo, Japan

[21] Appl. No.: 264,345

[22] Filed: Jun. 23, 1994

[30] Foreign Application Priority Data

Jun. 28, 1993 [JP] Japan ..... 5-178613
Jun. 9, 1994 [JP] Japan ..... 6-150621

[51] Int. Cl.[6] ..... G03G 9/08
[52] U.S. Cl. ..... 430/45; 430/47; 430/106
[58] Field of Search ..... 430/45, 47, 106, 109

[56] References Cited

U.S. PATENT DOCUMENTS

| | | | |
|---|---|---|---|
| 2,221,776 | 11/1940 | Carlson | 95/5 |
| 2,297,691 | 10/1942 | Carlson | 95/5 |
| 2,618,552 | 11/1952 | Wise | 95/1.9 |
| 2,874,063 | 2/1959 | Greig | 117/17.5 |
| 3,909,258 | 9/1975 | Kotz | 96/1 R |
| 4,904,558 | 2/1990 | Nagatsuka et al. | 430/122 |
| 5,120,631 | 6/1992 | Kanbayashi et al. | 430/106 |
| 5,137,796 | 8/1992 | Takiguchi et al. | 430/106.6 |
| 5,210,617 | 5/1993 | Tomiyana et al. | 358/300 |
| 5,217,836 | 6/1993 | Takiguchi et al. | 430/106.6 |
| 5,262,259 | 11/1993 | Chou et al. | 430/47 |
| 5,278,019 | 1/1994 | Ciccarelli et al. | 430/45 |
| 5,300,383 | 4/1994 | Tsubota et al. | 430/45 |

FOREIGN PATENT DOCUMENTS

| | | |
|---|---|---|
| 0330498 | 8/1989 | European Pat. Off. . |
| 0430674 | 6/1991 | European Pat. Off. . |
| 0458196 | 11/1991 | European Pat. Off. . |
| 42-23910 | 11/1967 | Japan . |
| 43-24748 | 10/1968 | Japan . |
| 51-3244 | 1/1976 | Japan . |
| 54-72054 | 6/1979 | Japan . |
| 58-129437 | 8/1983 | Japan . |
| 2-877 | 1/1990 | Japan . |
| 2-222966 | 9/1990 | Japan . |

OTHER PUBLICATIONS

Database WPI, Week 9212, Derwent Publications Ltd. AN 92-094173[12] for JPA 4-040467.

*Primary Examiner*—John Goodrow
*Attorney, Agent, or Firm*—Fitzpatrick, Cella, Harper & Scinto

[57] ABSTRACT

A color toner for developing an electrostatic image contains a binder resin and a colorant. The color toner has a weight average particle diameter of from 3 μm to 7 μm. The color toner contains from 10% to 70% by number of color toner particles with a particle diameter of 4.00 μm or smaller, not less than 40% by number of color toner particles with a particle diameter of 5.04 μm or smaller, from 2% to 20% by volume of color toner particles with a particle diameter of 8.00 μm or larger, and not more than 6% by volume of color toner particles with a particle diameter of 10.08 μm or larger. The color toner has such a coloring power that an image having been fixed on a transfer medium has an image density ($D_{0.5}$) of from 1.0 to 1.8 when an unfixed color toner on the transfer medium is in a quantity (M/S) of 0.50 mg/cm$^2$.

12 Claims, No Drawings

COLOR TONER AND PROCESS FOR ITS PRODUCTION

BACKGROUND OF THE INVENTION

1. Field of the Invention

This invention relates to a color toner used in a developer for developing an electrostatic image in image forming processes such as electrophotography, electrostatic recording and electrostatic printing. It also relates to a process for its production.

2. Related Background Art

It is conventionally known to form an image on the surface of a photoconductive material by an electrostatic means and develop the image.

A large number of methods are known, as disclosed in U.S. Pat. No. 2,297,691, Japanese Patent Publications No. 42-23910 and No. 43-24748 and so forth. In general, an electrostatic latent image is formed on a photo-sensitive member, utilizing a photoconductive material and various means, and subsequently a toner is caused to adhere onto the latent image to form a toner image corresponding to the electrostatic latent image.

Next, the toner image is transferred to an image holding medium such as paper if necessary, followed by fixing by the action of heat, pressure, heat and pressure, or solvent vapor. A copy is thus obtained. In a case where the process comprises a toner-image transfer step, the process is usually provided with the step of removing the toner remaining on the photosensitive member.

As developing methods by which the electrostatic latent image is formed into a visible image by the use of a toner, known methods can be exemplified by the powder cloud development as disclosed in U.S. Pat. No. 2,221,776, the cascade development as disclosed in U.S. Pat. No. 2,618,552, the magnetic brush development as disclosed in U.S. Pat. No. 2,874,063, and a method in which a conductive magnetic toner is used, as disclosed in U.S. Pat. No. 3,909,258.

As toners used in these developing methods, a fine powder obtained by mixing and dispersing a colorant in a thermoplastic resin has been commonly used. The thermoplastic resin most commonly includes polystyrene resins. Besides, polyester resins, epoxy resins, acrylic resins and urethane resins are also used. As the colorant, carbon black is most widely used in the case of non-magnetic toners. In the case of magnetic toners, black magnetic powder of an iron oxide type are widely used. In a system in which a two-component type developer is used, the toner is usually used in a mixture with carrier particles such as glass beads, iron powder and ferrite powder.

The toner image finally formed on a copy image holding medium such as paper is fixed onto the image holding medium by the action of heat, pressure or heat and pressure. In this fixing, the step of fixing by heat has been hitherto widely used.

In recent years, a rapid progress is being made in copying machines from monochromatic copying to full-color copying, and researches are made on two-color copying machines or full-color copying machines, which have been put into practical use. For example, Journal of Electrophotographic Society, Vol. 22, No. 1 (1983) and Journal of Electrophotographic Society, Vol. 25, No. 1, p.52 (1983) make reports relating to color reproduction and gradation reproduction.

Images formed by full-color electrophotography presently put into practical use, however, are not necessarily satisfactory for those who are accustomed to seeing color pictures that are by no means immediately compared with the actual object or original and also processed more beautifully than the actual object or original, as in television pictures, photographs and color prints.

In the aforesaid development of electrostatic latent images, the toner is blended with a carrier formed of relatively large particles and is used as a two-component type developer for electrophotography. The composition of the toner and the carrier is selected so that as a result of their mutual contact friction the toner can have a polarity reverse to the charges present on the photoconductive layer. As a result of contact friction between the two, the carrier electrostatically attracts the toner to its particle surfaces to transport the toner through a developing assembly and also feed the toner onto the photoconductive layer.

When, however, copies are continuously taken on a large number of copy sheets by an electrophotographic copying apparatus using such a two-component type developer, although sharp images with a good image quality can be obtained at the initial stage, fog may greatly occur and edge effect may seriously occur after copies have been taken on several tens of thousands of sheets, tending to result in images having poor gradation and sharpness.

In color copying carried out using toners with chromatic colors, continuous gradation is an important factor that influences image quality, and the edge effect that stresses only margins of images, occurring after copies have been taken on a large number of copy sheets, greatly damages the gradation of images. For example, quasi-contours due to the edge effect are formed in the vicinity of actual contours, resulting in a poor color reproducibility and copy reproducibility in color copying. Image area used in conventional black and white copying is 10% or less, where original images are almost held by line images as in letters, documents, reports and so forth. On the other hand, in the case of color copying, image area is at least 20%, and images are held by gradational solid images at a considerable occupancy as in photographs, catalogues, maps, pictures, etc.

When copies are continuously taken using such originals having a large image area, reproductions with a high image density can be obtained at the initial stage in usual instances, but the feeding of toner to the two-component type developer may become gradually insufficient to cause a decrease in density, or the toner being fed and the carrier may mix in an insufficient state, where the toner may have an insufficient triboelectricity to cause fog or cause a local increase or decrease in toner concentration (which indicates toner-carrier mixing ratio) on the developing sleeve, tending to result in blurred images or non-uniform in-image density. This tendency becomes more remarkable when the toner has a smaller particle diameter.

Such under-development and fog are presumed to be caused by an excessively low toner concentration in developer or a poop rise for rapid triboelectric charging between the toner being fed and the carrier contained in the two-component type developer, where any insufficiently charged toner thereby produced participates in development. It is necessary for developers having color toners to have the ability to always output images with a good image quality in the continuous copying of originals having a large image area. To deal with originals having a large image area and requiring a very large toner consumption, efforts have hitherto been made for improvements of developing apparatus than improvements of developers themselves. It has been attempted to increase the peripheral speed of a developing sleeve or allow a developing sleeve to have a larger diameter so that the developing sleeve can be brought into contact with electrostatic latent images more many times.

Such measures can be effective for improving developability, but tend to result in a decrease in the lifetime of apparatus because of an in-machine contamination due to toner scatter from developing assemblies or because of an overload on the drive members of developing assemblies. In some instances, measures are also taken in which developers are put in developing assemblies in large quantities in order to compensate the insufficiency of developability of the developers. Such measures, however, cause an increase in weight of copying machines, a cost increase due to the apparatus that must be made larger in size and an overload on the drive members of developing assemblies, and are not preferable.

For the purpose of improving image quality, several developers are proposed. For example, Japanese Patent Application Laid-open No. 51-3244 discloses a non-magnetic toner in which its particle size distribution is controlled so that the image quality can be improved. This toner is mainly composed of toner particles having a particle diameter of 8 to 12 μm, which are relatively coarse. According to studies made by the present inventors, it is difficult to "lay" the toner with such a particle diameter onto latent images in a uniform and dense state, and also the toner, as having the feature that particles with a particle diameter of 5 μm or smaller are in an amount of not more than 30% by number and particles with a particle diameter of 20 μm or larger are in an amount of not more than 5% by number, tends to cause a lowering of uniformity because of the broadness of its particle size distribution. In order to form sharp images by the use of the toner comprised of such relatively coarse toner particles and having a broad particle size distribution, the toner particles must be thickly overlaid so that any spaces between toner particles can be filled up to increase apparent image density. This brings about the problem of an increase in the consumption of toner necessary to attain a given image density.

Japanese Patent Application Laid-open No. 54-72054 discloses a non-magnetic toner having a sharper particle size distribution than the above toner. It, however, contains medium-size particles with a size as large as 8.5 to 11.5 μm, and has room for further improvement for a toner with a high resolution.

Japanese Patent Application Laid-open No. 58-129437 discloses a non-magnetic toner in which an average particle diameter is 6 to 10 μm and particles with a particle diameter of 5 to 8 μm are present in the greatest number. This toner, however, contains particles with a particle diameter of 5 μm or smaller in an amount as small as 15% by number, and tends to form images lacking in sharpness.

Japanese Patent Application Laid-open No. 2-222966 discloses a toner containing toner particles with a particle diameter of 5 μm or smaller in an amount of 15 to 40% by number. This has brought about a considerable improvement in image quality, but it is sought to achieve a more improved image quality.

Japanese Patent Application Laid-open No. 2-877 discloses a toner containing toner particles with a particle diameter of 5 μm or smaller in an amount of 17 to 60% by number. This has certainly brought about stable image quality and image density. However, if the toner has an extremely low coloring power, images with a poor highlight reproduction and fine-line reproduction are formed however properly the particle size distribution of the toner is controlled. In addition, the problem of density insufficiency occurs in solid areas. If on the other hand the toner has an excessively high coloring power, the problem of coarse images or fog also tends to occur in highlight areas. In order to stably obtain high-quality images, as stated above, not only the particle size distribution of toners but also the coloring power of toners are important factors.

SUMMARY OF THE INVENTION

An object of the present invention is to provide a color toner that has solved the problems discussed above, and a process for its production.

Another object of the present invention is to provide a color toner that may cause no decrease in image density and no blurred images even when color originals with a large image area are continuously copied, and a process for its production.

Still another object of the present invention is to provide a color toner that can achieve fog-free sharp image characteristics and a superior running stability, and a process for its production.

A further object of the present invention is to provide a color toner that can have less dependence of triboelectric charging on environment, and a process for its production.

A still further object of the present invention is to provide a color toner that can achieve a good transport performance in developing assemblies, and a process for its production.

A still further object of the present invention is to provide a color toner that has a high coloring power and can obtain a high image density, and a process for its production.

A still further object of the present invention is to provide a color toner that has a high chroma and a superior transparency, and a process for its production.

A still further object of the present invention is to provide a color toner that may cause no melt-adhesion of color toners to the insides of developing assemblies, i.e., component parts such as developing sleeves, blades and coating rollers, and a process for its production.

A still further object of the present invention is to provide a color toner that promises a good cleaning performance and may cause less filming to or contamination on a photosensitive member, and a process for its production.

The present invention provides a color toner for developing an electrostatic image, comprising a binder resin and a colorant, wherein;

said color toner has a weight average particle diameter of from 3 μm to 7 μm; contains from 10% to 70% by number of color toner particles with a particle diameter of 4.00 μm or smaller, not less than 40% by number of color toner particles with a particle diameter of 5.04 μm or smaller, from 2% to 20% by volume of color toner particles with a particle diameter of 8.00 μm or larger, and not more than 6% by volume of color toner particles with a particle diameter of 10.08 μm or larger; and has such a coloring power that an image having been fixed on a transfer medium has an image density ($D_{0.5}$) of from 1.0 to 1.8 when an unfixed color toner on the transfer medium is in a quantity (M/S) of 0.50 mg/cm$^2$.

The present invention also provides a process for producing a color toner, comprising the steps of kneading a pigment paste comprising from 5% to 50% by weight of a color pigment and from 95% to 50% by weight of a liquid dispersion medium, together with a binder resin, separating the liquid dispersion medium and dispersing the color pigment in the binder resin to obtain a color-pigment-containing kneaded product, further kneading the resulting color-pigment-containing kneaded product together with a binder resin to obtain a kneaded product, cooling the kneaded product followed by pulverization to obtain a pulverized product, and classifying the pulverized product to produce a color toner having a weight average particle diameter of from 3 μm to 7 μm; containing from 10% to 70% by number of color toner particles with a particle diameter of 4.00 μm or smaller, not less than 40% by number of color toner particles with a particle diameter of 5.04 μm or smaller, from 2% to 20% by volume of color toner particles with a particle diameter of 8.00 μm or larger, and not mope than 6% by volume of color toner particles with a particle diameter of 10.08 μm or larger; and having such a coloring power that an image having been fixed on a transfer medium has an image density ($D_{0.5}$) of from 1.0 to 1.8 when an unfixed color toner on the transfer medium is in a quantity (M/S) of 0.50 mg/cm$^2$.

DESCRIPTION OF THE PREFERRED EMBODIMENTS

Studies made by the present inventors have reached a discovery that toner particles with a size of 5 μm or smaller contribute the clear reproduction of contours of latent images and have a chief function of densely "laying" the toner onto the whole latent image. In particular, electrostatic latent images on a photosensitive member have a higher electric field intensity at their edges that form the contours than at their inner sides because of concentrated lines of electric force, and the quality of toner particles gathering at the contours influences the sharpness of image quality. The studies made by the present inventors-have revealed that the control of the quantity of toner particles with a size of 5 μm or smaller is effective for improving the sharpness of image quality.

The present inventors also made extensive studies on highlight reproduction, fine-line reproduction, image density and so forth. As a result, they have discovered that the use of a toner having a weight average particle diameter $D_4$ of $3 \leqq D_4 \leqq 7$ μm and a specific particle size distribution can make images have a high quality with a superior highlight reproduction, and also have discovered that a toner having a proper coloring power brings about an improvement in the uniformity at solid areas and highlight areas.

The weight average particle diameter and particle size distribution of the color toner will be described below in detail.

If the color toner has a weight average particle diameter larger than 7 μm, fine toner particles contributory to a high image quality become short to make it difficult for the toner to faithfully adhere to the fine latent images on a photosensitive member, make the highlight reproduction poor and also make it difficult to obtain a good resolution. Moreover, if the color toner has a weight average particle diameter larger than 7 μm, the toner tends to be excessively laid onto the latent images to tend to cause an increase in toner consumption.

If the color toner has a weight average particle diameter smaller than 3 μm, charges per unit weight of the toner tend to become extremely large in quantity to remarkably cause an insufficiency of image density of toner images, in particular, an image density insufficiency in an environment of low temperature and low humidity. This is not preferable in the case of images occupying a high areal proportion as in graphic images.

If the toner has a weight average particle diameter smaller than 3 μm, no smooth triboelectric charging with the carrier can be achieved to cause an increase in toner particles that can not be charged well, so that spots around images and fog may conspicuously occur. As a countermeasure for this problem, one may contemplate to make the carrier have a smaller particle diameter and have a larger specific surface area. However, the toner having a weight average particle diameter smaller than 3 μm tends to cause self-agglomeration of the toner to make it difficult to blend the toner with the carrier in a short time, after all tending to give a toner liable to cause a fog phenomenon development when copies are taken on a large number of copy sheets while continuously supplying the toner.

In the present invention, it is preferable for the color toner to have a weight average particle diameter of from 3 to 7 μm.

The color toner of the present invention contain toners particles with a particle diameter of 4 μm or smaller in an amount of from 10% to 70% by number, and preferably from 15 to 60% by number, of the whole toner particles. If the toner particles with a particle diameter of 4 μm or smaller are in a content less than 10% by number, fine toner particles, which is an essential component for a high image quality, become short to cause a decrease in effective toner particle components as the toner is consumed when copying or printing out is continued, resulting in a loss of balance in the particle size distribution of the toner to tend to cause a gradual lowering of image quality.

If such toner particles are in a content more than 70% by number, the agglomeration between toner particles tends to occur to form toner masses, so that coarse images may be formed, the resolution may be lowered, or latent images may have a large difference in density between their edges and inner sides to tend to provide images with slightly blank areas.

The toner particles with a particle diameter of 8.00 μm or larger should be in a content of from 2% to 20% by volume, and preferably from 3.0 to 18.0% by volume. If they are in a content mope than 20.0% by volume, the image quality may become poor, and the toner may be excessively laid onto the electrostatic latent images to cause an increase in toner consumption. If, on the other hand, they are in a content less than 2.0% by volume, developability may become poor because of a decrease in flowability of the toner.

In order to improve chargeability and flowability of the toner, toner particles with a particle diameter of 5.04 μm or smaller should be in a content of more than 40% by number to not more than 90% by number, and mope preferably more than 40% by number to not more than 80% by number, and toner particles with a particle diameter of 10.08 μm or larger should be in a content of from 0 to 6% by volume, and preferably from 0 to 4% by volume.

The coloring power of the toner will be described below.

In the color toner of the present invention, the toner has such a coloring power that an image having been fixed on a transfer medium has an image density ($D_{0.5}$) of $1.0 \leqq D_{0.5} \leqq 1.8$, and preferably $1.2 \leqq D_{0.5} \leqq 1.5$ when an unfixed color toner on the transfer medium is in a quantity (M/S) of 0.50 mg/cm$^2$. In such a case, better color images can be obtained.

The dispersed particle diameter of colorant particles in the color toner and its relation with the coloring power will be described below.

The present inventors have discovered that the color toner having the particle size distribution as described above can be made more effective and superior uniformity at highlight areas and reproduction of color tones in a wide range can be achieved when the colorant particles in the toner particles are uniformly dispersed and their dispersed particle diameters are controlled.

When colorant particles in the color toner particles have a number average particle diameter larger than 0.7 μm, agglomerate colorant particles with a large particle diameter are present in a large number. This makes it difficult to achieve a good color tone reproduction and tends to cause a decrease in transparency when color images are formed on OHP sheets used in overhead projectors. This also tends to cause uneven triboelectric chargeability between color toner particles to make it difficult to form color images in a high quality because of a broad distribution of the quantity of triboelectricity of the color toner.

In order to reproduce color tones in a wide range when full-color images are formed using a cyan color toner, a yellow color toner and a magenta color toner, it is important for the color toner particles to contain colorant particles with a particle diameter of from 0.1 to 0.5 μm in an amount of not less than 60% by number, preferably not less than 65% by number, and more preferably not less than 70% by number. Hitherto, they have took notice of only the average particle diameter of colorants. However, even if colorants have the same average particle diameter, unauthorized irregular reflection of light may occur when the colorants have a broad particle size distribution, tending to result in a decrease in coloring power and also a lowering of color tone reproduction in the case of subtractive color mixture.

When colorant particles with a particle diameter of 0.8 μm or larger are present in a large number, the transparency and sharpness of projected images of the color images formed on OHP sheets may become poor. Hence, it is important for the colorant particles with a particle diameter of 0.8 μm or larger to be in a content of not more than 10% by number, and preferably not more than 8% by number. The colorant particles with a particle diameter of 0.8 μm or larger, which are present on the surfaces of the color toner particles, may come off during continuous image reproduction to tend to contaminate the surfaces of carrier particles, developing sleeve, photosensitive member, etc., and also tend to cause faulty cleaning.

As for colorant particles with a particle diameter smaller than 0.1 μm, such particles are presumed to have no particular bad influence on the reflection and absorption of light.

The color toner of the present invention has a coloring power in which the image density $D_{0.5}$ is 1.0 to 1.8. An instance where the color density $D_{0.5}$ is smaller than 1.0 means that the color toner has a low coloring power, which brings about the problem of a density insufficiency in solid areas. An attempt to eliminate such a problem by making larger the quantity of color toners on a transfer medium results in an increase in color toners consumed for image reproduction, and makes it necessary to frequently supply the color toners to developing assemblies. This not only results in a cost disadvantage but also makes it difficult to uniformly agitate color toners and carriers in developing assemblies, and tends to cause image uneveness when solid images are outputted, making it difficult to obtain uniform solid images.

If the color toner has a coloring power in which the image density $D_{0.5}$ is larger than 1.8, a minute electrostatic latent image on a photosensitive drum must be developed by the color toner in an extremely small quantity. This tends to make coarse images conspicuous in highlight areas and also tends to make fog conspicuous.

The color toner of the present invention may preferably have a coloring power of $1.2 \leqq D_{0.5} \leqq 1.7$.

In the present invention, the weight average particle diameter $D_4$ and image density $D_{0.5}$ of the color toner may preferably satisfy the condition of;

$$(16-D_4)/10 \leqq D_{0.5} \leqq (23-D_4)/10.$$

An instance of $(16-D_4)/10 > D_{0.5}$ means that the color toner has a low coloring power for its particle diameter, which tends to cause image density insufficiency. Especially when the color toner is made to have a smaller particle diameter, charges of the color toner tend to become larger in quantity, where the density is liable to be led to insufficiency. The particle diameter of a color toner and the coloring power of the color toner are important factors on which the image quality depends. Especially when the color toner has a smaller particle diameter, it is important for the color toner to have a high coloring power so that the condition of $(16-D_4)/10 \leqq D_{0.5}$ is satisfied.

An instance of $(23-D_4)/10 < D_{0.5}$ means that the color toner has a high coloring power, which tends to cause a lowering of gradation reproduction in highlight areas.

To produce the color toner of the present invention, a colorant paste comprising a color pigment and a liquid dispersion medium (e.g., water) is used. The colorant paste is meant to be those in which the color pigment is not in the form of powder in the course of its production and the greater part of particles of the color pigment are dispersed in the liquid dispersion medium in the form of primary particles. The colorant paste used may include those in which 5% to 50% by weight of the color pigment is dispersed in 95% to 50% by weight of the liquid dispersion medium. The liquid dispersion medium may preferably be a liquid capable of evaporating upon heating at normal pressure, and may contain a dispersion stabilizer or aid. From the viewpoint of ecology, the liquid dispersion medium may preferably be water. As the color pigment, those substantially insoluble in the liquid dispersion medium may be used.

Use of a colorant paste containing more than 50% by weight of the color pigment may make it hard to uniformly disperse the color pigment in the binder resin, where, in order to improve dispersibility, it is necessary to carry out melt-kneading at a higher temperature, for a longer time or under a stronger shear force during the kneading. In such a case, the binder resin undesirably tends to deteriorate or cause a break of polymer chains constituting the binder resin. On the other hand, if a colorant paste containing less than 5% by weight of the color pigment is used, the colorant paste must be used in a large amount in order to produce a color toner having a high coloring power, and also it becomes necessary to use a great energy for removing the liquid dispersion medium after the liquid dispersion medium and the colorant paste have been kneaded.

When the colorant paste and the binder resin are kneaded or mixed, the color pigment and the binder resin may preferably be in a weight ratio of from 10:90 to 50:50, and mope preferably from 15:85 to 45:55, in terms of solid content.

If the weight ratio of the color pigment to the binder resin is less than 10% by weight, the binder resin must be charged in a kneading machine in a large amount based on the weight of the colorant paste, where the color pigment tends to segregate in the kneaded product. In order to bring it into a uniform system, the kneading time must be set longer. This results in an excessive load applied to the binder resin. If, on the other hand, the weight ratio of the color pigment to the binder resin is more than 50% by weight, the color pigment in the liquid phase is difficult to smoothly transfer to the binder resin. In addition, it is difficult for the kneaded product to be in a uniform molten state when the materials are melt-kneaded after the transfer of pigment, so that it becomes hard to achieve a good and uniform dispersibility.

In the present invention, as a first step, the kneading may preferably be carried out under application of no pressure. The binder resin may preferably have a softening temperature Tm of from 90° C. to 115° C. as calculated from a flow tester curve. If the binder resin has a softening temperature Tm higher than 115° C., the binder resin tends to insufficiently melt in the step of kneading under application of no pressure, so that it is difficult for the pigment paste to be distributed or transferred from the aqueous phase to the molten resin phase, making it hard for the pigment to be dispersed to a given dispersed particle diameter. A binder resin having a Tm higher than 115° C. can give good anti-offset properties to the toner, but may make color mixing performance poor and make it hard to obtain smooth fixed images.

A binder resin having Tm lower than 90° C. enables smooth progress of the step of kneading, but tends to cause blocking in the toner thus produced, making it hard to achieve good anti-offset properties. Moreover, the in-machine melt-adhesion of the toner tends to occur.

The reason why the melt-kneading is carried out under application of no pressure is as follows: Under application of a pressure, there is a possibility that the liquid dispersion medium (e.g., water) in the pigment paste vigorously attacks, e.g., polyester resin to cause hydrolysis in part or to cause a change in properties of the binder resin. Hence, the pigment paste and the binder resin are preferably kneaded under application of no pressure.

A kneading device can be exemplified by a heating kneader, a single-screw extruder, a twin-screw extruder and a kneader-extruder. A heating kneader is particularly preferred.

The colorant suited for what is intended in the present invention may include conventionally known color pigments. In particular, organic pigments with a high lipophilicity are preferred.

For example, they include Naphthol Yellow S, Hanza Yellow G, Permanent Yellow NSG, Permanent Orange GTR, Pyrazolone Orange, Benzidine Orange G, Permanent Red R, Watching Red calcium salt, Brilliant Carmine 38, Fast Violet B, Methyl Violet Lake, Phthalocyanine Blue, Fast Sky Blue, and Indanthrene Blue BC.

Highly light-fast pigments such as polycondensation azo pigments, insoluble azo pigments, perylene pigments, anthraquinone pigments, quinacridone pigments, isoindolinone pigments, copper phthalocyanine pigments are preferred.

Magenta color pigments may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Pigment Vat Red 1, 2, 10, 13, 15, 23, 29, 35.

Cyan color pigments may include C.I. Pigment Blue 2, 3, 15, 16, 17; C.I. Vat Blue 6; and C.I. Acid Blue 45 or a copper phthalocyanine pigment having the structure as shown by formula (1) below, having a phthalocyanine skeleton substituted with 1 to 5 phthalimidomethyl group(s).

(1)

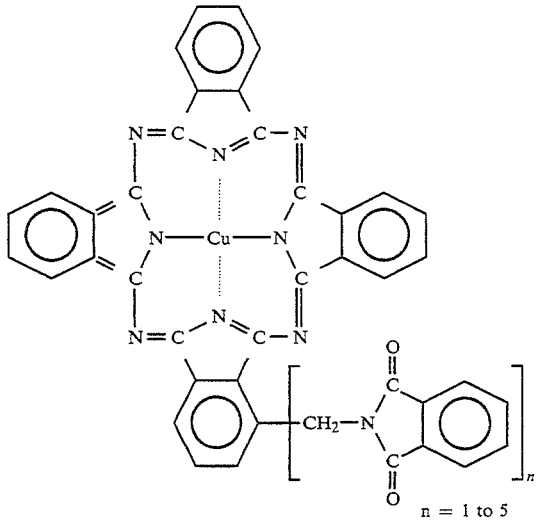

Yellow color pigments may include C.I. Pigment Yellow 1, 2, 3, 4, 5, 6, 7, 10, 11, 12, 13, 14, 15, 16, 17, 23, 65, 73, 83; and C.I. Vat Yellow 1, 3, 20.

The colorant used for producing the color toner of the present invention should preferably be in the form of a pigment paste that has never been in a powdery state in the stage prior to its mixing with the binder resin. If a color pigment brought into a powder by drying is mixed with the liquid dispersion medium, it is difficult for color pigment particles to be dispersed in the state of primary particles with difficulty. Thus, it is not preferable to do so.

The colorant may be used in an amount of from 0.5 part to 12 parts by weight, and preferably from 1 part to 10 parts by weight, based on 100 parts by weight of the binder resin of the toner.

Its use in an amount more than 12 parts by weight makes it difficult to obtain a high transparency. In particular, it tends to result in a lowering of transparency and color reproduction of mixed colors, green, red and blue, and also result in a lowering of reproduction of skin colors of human bodies. The use of the colorant in an amount more than 12 parts by weight may also make color toner charges greatly variable depending on color differences or make it difficult to attain the intended absolute value of charges.

Use of the colorant in an amount less than 0.5 part by weight makes it difficult to achieve the intended color toner, and makes it difficult to obtain high-quality images with a high image density.

In the present invention, the color toner should also have a degree of agglomeration of from 2 to 25%, preferably from 2 to 20%, and more preferably from 2 to 15%.

Color toners made to have a weight average particle diameter as small as 3 to 7 μm commonly tend to have a high degree of agglomeration, and those having a degree of agglomeration of more than 25% tend to cause the problems of a lowering of transport performance of the color toner fed from a toner hopper to a developing assembly, a poor mixing performance between the color toner and the carrier and also a poor charge performance of the color toner. Hence, it is hard to obtain images with a high quality even if the color toner is made finer and made to have a proper coloring power.

For the purpose of decreasing the degree of agglomeration of the color toner, it is common to add fine silica powder having a large BET specific surface area. However, the addition of fine silica powder tends to cause a lowering of environmental properties of the color toner, tending to cause a decrease in charges of the color toner in an environment of high humidity and an increase in charges of the color toner in an environment of low humidity. Moreover, the fine silica powder has a great negative chargeability in itself, and hence its use as an external additive results in an increase in static coalescence between color toner particles to make it hard to obtain a color toner with a high flowability as intended.

Some fine titanium oxide particles have a small primary particle diameter of about 20 μm. Such fine titanium oxide partieles have many agglomerates of primary particles because of their production process, and it is not necessarily easy to achieve the degree of agglomeration of the color toner at which the present invention aims.

The fine titanium oxide particles have originally a smaller surface activity than silica, and many of them have not necessarily been made well hydrophobic. Although hydrophobicity may increase when a treating agent is used in a large quantity or a highly viscous treating agent is used, the fine titanium oxide particles tend to coalesce one another.

In the present invention, it is preferable to use as an external additive, surface-treated fine titanium oxide particles with an average particle diameter of from 0.01 to 0.2 μm and a hydrophobicity of from 20 to 98%, having been treated with a coupling agent.

The coupling agent may include silane coupling agents and titanium coupling agents. Silane coupling agents are particularly preferably used, which are those represented by the formula:

$$R_mSiY_n$$

wherein R is an alkoxyl group; m is an integer of 1 to 3; Y is a hydrocarbon group such as an alkyl group, a vinyl group, a glycidoxyl group. or a methacrylic group; and n is an integer of 1 to 3.

For example, it may include vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane.

More preferable coupling agents are those represented by $C_aH_{2a+1}$—Si—(—$OC_bH_{2b+1})_3$, wherein a is 4 to 12 and b is 1 to 3.

Here, if a in the formula is smaller than 4, the treatment becomes easier, but the hydrophobicity may become low. If a is larger than 12, a satisfactory hydrophobicity can be achieved but the coalescence of titanium oxide particles may increase, resulting in a lowering of flowability-providing performance. If b is larger than 3, the reactivity may become low to make the particles insufficiently hydrophobic. Hence, in the present invention, a should be 4 to 12, and preferably 4 to 8, and b should be 1 to 3, and preferably 1 or 2.

The particles should be treated in an amount of from 1 to 50% by weight, and preferably from 3 to 40% by weight, based on 100 parts by weight of the fine titanium oxide particles, and should be made to have a hydrophobicity of from 20 to 98%, preferably from 30 to 90%, and more preferably from 40 to 80%.

If the hydrophobicity is less than 20%, charges may greatly decrease when the toner is left standing for a long period of time in an environment of high humidity, so that a mechanism for charge acceleration becomes necessary on the side of developing assemblies, resulting in a complicated apparatus. If the hydrophobicity is more than 98%, it becomes difficult to control the charging of titanium oxide itself, tending to result in charge-up of the toner in an environment of low humidity.

In view of the flowability-providing performance, the fine titanium oxide particles should have a particle diameter of from 0.01 to 0.2 μm. If it has a particle diameter larger than 2 μm, the flowability can be improved less effectively. If they have a particle diameter smaller than 0.01 μm, the particles tend to be embedded in toner particle surfaces to cause an early deterioration of the toner, resulting in a lowering of durability or running performance. This more remarkably tends to occur in the case of a sharp-melting color toners. The particle diameter of the fine titanium oxide particles may be measured using, for example, a transmission electron microscope.

In the present invention, the fine titanium oxide particles thus treated may preferably have a light transmittance of 40% or more at a light wavelength of 400 nm.

The fine titanium oxide particles have a primary particle diameter of as small as 0.2 to 0.01 μm. When, however, actually incorporated into the toner, they ape not necessarily dispersed in the form of primary particles, and may sometimes be present in the form of secondary particles. Hence, however small the primary particle diameter is, the treatment may become less effective if the particles behaving as secondary particles have a large effective diameter.

Those having a higher light transmittance at 400 nm which is the minimum wavelength in the visible region when dispersed in a liquid phase have a smaller secondary particle diameter. Thus, good effects can be obtained for the flowability-providing performance, the sharpness of projected images in OHP, etc.

The reason why 400 nm is selected is that it is a wavelength at a boundary region between ultraviolet and visible, and also it is said that light passes through particles with a diameter not larger than ½ of light wavelength. In view of these, any transmittance at wavelengths beyond 400 nm becomes higher as a matter of course and is not so meaningful.

As a method for obtaining hydrophobic fine titanium oxide particles, there is a method in which a volatile titanium alkoxide or the like is oxidized at a low temperature to make it spherical, followed by surface treatment to,obtain an amorphous spherical titanium oxide.

The fine titanium oxide particles are preferable when used in combination with the toner having the particle size distribution according to the present invention. The surface area per unit weight increases as the toner particles are made to have a smaller particle diameter, tending to cause excessive charging due to rubbing friction. As a countermeasure for it, the fine titanium oxide particles capable of controlling charging and imparting flowability are greatly effective. The fine titanium oxide particles may preferably be contained in an amount of from 0.5 to 5.0% by weight, preferably from 0.7 to 3.0% by weight, and more preferably from 1.0 to 2.5% by weight.

As a binder resin used in the toner (i.e., colorant-containing resin particles) of the present invention, various resins conventionally known as toner binder resins for electrophotography can be used.

For example, it may include polystyrene, styrene copolymers such as a styrene/butadiene copolymer and a styrene/acrylate copolymer, polyethylene, ethylene copolymers such as an ethylene/vinyl acetate copolymer and an ethylene/vinyl alcohol copolymer, phenol resins, epoxy resins, acrylphthalate resins, polyamide resins, polyester resins, and maleic acid resins.

It is particularly preferable to use polyester resins having a high negative chargeability. The polyester resins can achieve excellent fixing performance and are suited for color toners.

In particular, the following polyester resin is preferred because of its sharp melt properties, which is a polyester resin obtained by co-condensation polymerization of i) a diol component comprised of a bisphenol derivative or substituted bisphenol represented by the formula:

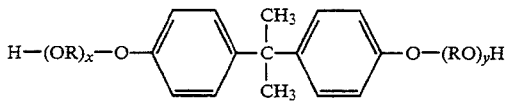

wherein R represents an ethylene group or a propylene group, and x and y each represent an integer of 1 or more, where x+y is 2 to 10 on the average;

and ii) a carboxylic acid component comprising a dibasic or higher basic carboxylic acid or an acid anhydride or lower alkyl ester thereof, as exemplified by fumaric acid, maleic acid, maleic anhydride, phthalic acid, terephthalic acid, trimellitic acid and pyromellitic acid.

In particular, the binder resin may have an apparent viscosity of from $5\times10^4$ to $5\times10^6$ poises, preferably from $7.5\times10^4$ to $2\times10^6$ poises, and mope preferably from $10^5$ to $10^6$ poises, at 90° C., and an apparent viscosity of from $10^4$ to $10^5$ poises, preferably from $10^4$ to $3\times10^5$ poises, and more preferably from $10^4$ to $2\times10^5$ poises, at 100° C. The toner satisfying the above condition makes it possible to obtain color OHP with a good light transmittance, and also obtain good results for fixing performance, color mix properties and high-temperature anti-offset properties when used in full-color toners. It is particularly preferred that an absolute value of difference between apparent viscosity $P_1$ at 90° C. and apparent viscosity $P_2$ at 100° C. is within the range of;

$$2\times10^5<|P_1-P_2|<4\times10^6.$$

Where the toner of the present invention has a negative chargeability, a charge control agent may be added so that its charge performance can be stabilized. A negative charge control agent may include organic metal complexes as exemplified by a metal complex of alkyl-substituted salicylic acid, e.g., a chromium complex or zinc complex of di-tertbutylsalicylic acid.

Where the toner has a positive chargeability, the toner may preferably contain a charge control agent which shows a positive chargeability. For example, it may include Nigrosine, triphenylmethane compounds, rhodamine dyes and polyvinyl pyridine. When color toners are produced, it is preferable to use binder resins in which amino-containing carboxylic acid esters such as dimethylaminomethyl methacrylate showing a positive chargeability are contained as monomers in an amount of from 0.1 to 40 mol%, and preferably from 1 to 30 mol%, or to use colorless or pale-color positive charge control agents having no influence on the tones of toners.

The color toner particles of the present invention can be produced by thoroughly mixing a thermoplastic resin with a pigment or dye as a colorant, a charge control agent and other additives by means of a mixing machine such as a ball mill, thereafter melt-kneading the mixture using a heat kneading machine such as a heat roll, a kneader or an extruder to make resins melt together, dispersing or dissolving a pigmentor dye in the molten product, and solidifying it by cooling, followed by pulverization and strict classification to obtain color toner particles.

As a carrier which may be used in combination with the toner of the present invention, it is possible to use surface-oxidized or -unoxidized metal particles of iron, nickel, copper, zinc, cobalt, manganese, chromium or rare earth elements, alloys thereof, oxides thereof, or ferrite.

Particle surfaces of the carrier may preferably be coated with resin or the like. As methods therefor, it is possible to use a method in which a coating material such as resin is dissolved or suspended in a solvent and the resulting solution or suspension is made to adhere to the carrier particle, and a method in which they are merely mixed in a powdery form.

A material adherent to the carrier particle surfaces may include polytetrafluoroethylene, monochlorotrifluoroethylene polymers, polyvinylidene fluoride, silicone resins, polyester resins, metal complexes of di-tertiary-butylsalicylic acid, styrene resins, acrylic resins, polyamide, polyvinyl butyral, Nigrosine, aminoacrylate resins, basic dyes and lakes thereof, fine silica powder and fine alumina powder. Any of these may be used alone or in combination.

The treatment with the above adherent material may preferably be made usually in a total weight of from 0.1 to 30% by weight, and more preferably from 0.5 to 20% by weight, based on the weight of the carrier.

The carrier should have an average particle diameter of from 10 to 100 μm, and preferably from 20 to 70 μm.

As a particularly preferred embodiment, the carrier may comprise Fe ferrite, whose particle surfaces are coated with a fluorine-type resin or a styrene-type resin. For example, the surfaces may be coated with polyvinylidene fluoride, styrene-methyl methacrylate resin, polytetrafluoroethylene, styrene-methyl methacrylate resin, or a mixture of any of these.

The above coated ferrite carrier can give a preferable triboelectric chargeability to the color toner of the present invention, and also is effective for improving electrophotographic performance.

When the carrier is blended with the toner according to the present invention to produce a two-component type developer, the toner may be in a mixing proportion of from 2% by weight to 15% by weight, and preferably from 4% by weight to 13% by weight, as a toner concentration in the developer, whereby good results can usually be obtained. If the toner concentration is less than 2% by weight, the image density tends to become low. If it is more than 15% by weight, fog and in-machine toner scatter tend to occur.

Measurement of the respective characteristic values will be described below.

Measurement of particle size distribution of the color toner:

A Coulter counter TA-II or Coulter Multisizer II (manufactured by Coulter Electronics, Inc.) is used as a measuring device. As an electrolytic solution, an aqueous 1% NaCl solution is prepared using first-grade sodium chloride. For example, ISOTON-II (trade name; available from Coulter Scientific Japan Co.) can be used. Measurement is carried out by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes using an ultrasonic. dispersion machine. The volume and number of toner particles are measured for each channel by means of the above measuring device, using an aperture of 100 μm as its aperture to calculate the volume distribution and number distribution of the toner particles. Then, a weight-based weight average particle diameter ($D_4$: a center value of each channel is regarded as a representative value of every channel) of the toner, obtained from the volume distribution of the toner particles is determined.

As channels, there are used 13 channels of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm and 32 to 40.30 μm.

Measurement of average particle diameter of the colorant:

Colorant particles are added to a 2.3M sucrose solution, followed by thorough stirring. A small amount of the resulting solution is applied to a sample holder pin, which is subsequently put into liquid $N_2$ to solidify, and immediately thereafter set on a sample arm head. Using an ultramicrotome FC4E (manufactured by Nissei Sangyo K.K.) provided with a cryogenic device, the solidified product was cut according to a conventional method to prepare samples.

Photographs of the samples are taken on an electron microscope H-8000 Type (manufactured by Hitachi, Ltd.) at an accelerating voltage of 100 kV. Magnifications are set arbitrarily in accordance with the samples.

Image information thus obtained is inputted to an image analyzer LUZEX 3, manufactured by Nicore Co., through an interface to convert it into binary image data. Among them, only those concerning colorant particles having a particle diameter of 0.1 μm or larger are analyzed at random, where the measurement is repeated until the sampling has been made 300 times or more, and the number average particle diameter and particle size distribution of the colorant, which are necessary for the present invention, are determined.

Here, only the particles larger than 0.1 μm are picked up for the measurement. The particle diameter referred to in the present invention is a value defined by a diameter obtained after approximating the image of each colorant particle to a sphere.

Measurement of apparent viscosity and softening temperature:

A flow tester CFT-500 Type (manufactured by Shimadzu Corporation) is used. As a sample, a 60 mesh-pass product is weighed in an amount of about 1.0 to 1.5 g. The sample is pressed using a molder under a load of 100 kg/m$^2$ for 1 minute.

The resulting pressed sample is measured under conditions shown below, using the flow tester in an environment of normal temperature and normal humidity (temperature: about 20°–30° C.; humidity: 30–70% RH) to obtain a humidity-apparent viscosity curve. From the smooth curve thus obtained, an apparent viscosity at 90° C. and 100° C. each is determined, and the resulting value is regarded as the apparent viscosity of the sample with respect to temperature of the sample. Temperature ($T_{\frac{1}{2}}$) is also determined from the smooth curve, which is a temperature at the time the sample flows out by 50% by volume, and the resulting value is regarded as softening temperature Tm.

Rate of temperature rise: 6.0 D/M (°C./min)
Set temperature: 70.0 DEG (°C.)
Maximum temperature: 200.0 DEG (°C.)
Interval: 3.0 DEG (°C.)
Preheating: 300.0 SEC (seconds)
Load: 20.0 KGF (kg)
Die diameter: 1.0 MM (mm)
Die length: 1.0 MM (mm)
Plunger: 1.0 CM$^2$ (cm$^2$)

Measurement of degree of agglomeration:

As a means for measuring the flowability of a sample (e.g., the toner having the external additives), the degree of agglomeration is used. As the value of the degree of agglomeration is larger, the flowability of the sample is judged to be poorer.

As a measuring apparatus, Powder Tester (manufactured by Hosokawa Micron Corporation) having a digital vibroscope (DEGIVIBRO MODEL 1332) is used.

To make the measurement, 200 mesh, 100 mesh and 60 mesh sieves are overlaid one another on a vibrating pedestal in order of mesh of smaller openings, i.e, in order of 200 mesh, 100 mesh and 60 mesh sieves so that the 60 mesh sieve is uppermost.

On the 60 mesh sieve of the sieves set in this way, a sample precisely weighed in an amount of 5 g is placed, the input voltage applied to the vibrating pedestal is set to 21.5 V and the value of displacement of the digital vibroscope is set to 0.130, where the vibrational amplitude of the vibrating pedestal is so adjusted as to be within the range of 60 to 90 μm (rheostat gauge: about 2.5), and the sieves are vibrated for about 15 seconds. Then, the weight of the sample remaining on each sieve is measured to calculate the degree of agglomeration according to the following expression:

$$\text{Degree of agglomeration (\%)} = \frac{\text{Sample weight on 60 mesh sieve}}{5\text{ g}} \times 100 + \frac{\text{Sample weight on 100 mesh sieve}}{5\text{ g}} \times 100 \times 3/5 + \frac{\text{Sample weight on 200 mesh sieve}}{5\text{ g}} \times 100 \times 1/5$$

The sample used is a sample having been left standing in an environment of 23° C. and 60% RH for about 12 hours. The measurement is made in an environment of 23° C. and 60% RH.

Measurement of average particle diameter of fine titanium oxide particles:

With regard to the primary particle diameter, fine titanium oxide particles are observed on a transmission electron microscope, and particle diameters of 100 particles in the visual field are measured to determine their average particle diameter. With regard to the particle diameter of dispersed particles on the toner, the particles are observed on a scanning electron microscope, and 100 fine titanium oxide particles in the visual field are qualitatively analyzed using an XMA (X-ray microanalyzer), where the particle diameters are measured to determine their average particle diameter.

Measurement of hydrophobicity:

Methanol titration is an experimental means for ascertaining the hydrophobicity of fine titanium oxide particles whose surfaces have been made hydrophobic.

"Methanol titration" prescribed in the present specification to evaluate the hydrophobicity of treated fine titanium oxide particles is carried out in the following way: 0.2 g of fine titanium oxide particles to be tested are added to 50 ml of water put in a container. Methanol is dropwise added from a buret until the whole fine titanium oxide particles have been wetted. Here, the solution inside the container is continually stirred using a magnetic stirrer. The end point can be observed upon suspension of the whole fine titanium oxide particles in the solution. The hydrophobicity is expressed as a percentage of the methanol present in the liquid mixture of methanol and water when the reaction has reached the end point.

| Measurement of transmittance: | |
|---|---|
| Sample | 0.10 g |
| Alkyd resin | 13.20 g *1 |
| Melamine resin | 3.30 g *2 |
| Thinner | 3.50 g *3 |
| Glass media | 50.00 g |

*1 BECKOZOLE 1323-60-EL, available from Dainippon Ink & Chemicals, Incorporated

*2 SUPER BECKAMINE J-820-60, available from Dainippon Ink & Chemicals, Incorporated

*3 AMILUCK THINNER, available from Kansai Paint Co., Ltd.

Materials with the above composition are collected in a 150 cc glass bottle, and dispersion is carried out for 1 hour using a paint conditioner manufactured by Red Devil Co. After the dispersion has been completed, the dispersed product is coated on a PET film by means of a 2 mil. doctor blade. The coating thus formed is heated at 120° C. for 10 minutes to carry out baking, and the sheet thus obtained is set on U-BEST, manufactured by Nihon Bunkou Co., to measure its transmittance in the range of 320 to 800 nm and make comparison.

Measurement of image density ($D_{0.5}$):

A color toner image on which color toner is laid in an amount of 0.5 mg per 1 $cm^2$ is formed on a transfer medium, and then a fixed image in which the color image having been fixed has a gloss of 10% or more is formed.

The gloss is measured using a gloss meter (GLOSS METER UD) manufactured by Toyo Seiki K.K.) on the basis of 75° reflected light of the light at the incident angle of 75°.

The image density is measured using, example, a Macbeth densitometer or a color reflection densitometer X-RITE 404A, manufactured by X-Rite Co.

EXAMPLES

In the following, "part(s)" refer to "part(s) by weight".

Example 1

| | |
|---|---|
| Polyester resin obtained by condensation of propoxylated bisphenol-A with fumaric acid (Tm: 95° C.) | 70 parts |
| Cyan pigment paste of C.I. Pigment Blue 15:3 (pigment solid content: 30% by weight; water content: 70% by weight) | 100 parts |

The cyan pigment paste used was one having never been in the step of being formed into powder after its preparation.

The above materials were put in a kneader type mixer. While mixing them, the temperature was gradually raised under application of no pressure in an open system. At the time the temperature reached 90° to 100° C., after making sure that the particles of the cyan pigment in the aqueous phase had been distributed or transferred to the polyester resin phase, heat melt-kneading was continued for further 30 minutes. After the kneading, heated water having been separated was discharged from the mixer, and the temperature of the mixer was raised to 130° C., where the polyester resin in which the cyan pigment particles had been dispersed was heat melt-kneaded for about 30 minutes to further uniformly disperse the cyan pigment particles and remove the water content. After the kneading, the kneaded product was cooled, and the kneaded product thus cooled was pulverized to obtain cyan pigment-containing polyester resin particles with a particle diameter of 1 mm or less.

| | |
|---|---|
| Cyan pigment-containing polyester resin particles (cyan pigment content: 30% by weight) | 16.7 parts |
| Polyester resin set out above (Tm: 95° C.) | 88.3 parts |
| Negative charge control agent (a chromium complex) | 4 parts |

The above materials were thoroughly premixed using a Henschel mixer, and the mixture was melt-kneaded using a twin-screw extruder. After cooled, the kneaded product was crushed using a hammer mill to have a particle diameter of about 1 to 2 mm. Subsequently, the crushed product was finely pulverized using a fine grinding mill of an air-jet system. Then the finely pulverized product obtained was set on a multi-division classifier to strictly remove fine power and coarse powder at the same time. Thus, a cyan color toner was obtained, which has a weight average particle diameter of 6.0 μm and contains 22.6% by number of toner particles with a particle diameter of 4 μm or smaller, 49.6% by number of toner particles with a particle diameter of 5.04 μm or smaller, 50% by volume of toner particles with a particle diameter of 8 μm or larger and 0.5% by volume of toner particles with a particle diameter of 10.08 μm or larger.

In the cyan color toner particles, the cyan pigment particles had a number average particle diameter of 0.38 μm, and cyan pigment particles with a particle diameter of from 0.1 to 0.5 μm were present in a content of 82.0% by number and cyan pigment particles with a particle diameter of 0.8 μm or larger in a content of 0.8% by number.

Meanwhile, hydrophilic fine titanium oxide particles (average particle diameter: 0.02 μm; BET specific surface areas: 140 $m^2/g$) were surface-treated with $n\text{-}C_4H_9\text{—}Si\text{—}(\text{—}OCH_3)_3$ used in an amount of 20 parts based on 100 parts of the former to obtain hydrophobic fine titanium oxide particles with an average particle diameter of 0.02 μm, a hydrophobicity of 70% and a transmittance of 60% at 400 nm.

Next, 100 parts of the cyan color toner and 1.5 parts of the hydrophobic fine titanium oxide particles were mixed to prepare a cyan color toner having on its particle surfaces the hydrophobic fine titanium oxide particles. The cyan toner had a degree of agglomeration of 9%. This toner had an apparent viscosity of $5\times10^5$ poises at 90° C. and an apparent viscosity of $5\times10^4$ poises at 100° C.

Next, 5 parts of the above cyan color toner and 95 parts of a resin-coated magnetic ferrite carrier coated with about 1% by weight of a methyl methacrylate/butyl acrylate copolymer were blended to produce a two-component type developer.

This two-component type developer was put into a commercially available plain-paper full-color copying machine (COLOR LASER COPIA 550, trade name; manufactured by Canon Inc.) to make a copying test. In this copying machine, its fixing roller had a diameter of 60 mm, comprised of a mandrel made of a 5 mm thick aluminum material, having on its outer surface a 2 mm thick RTV (room temperature vulcanized) silicone rubber layer, a 50 μm thick fluorine rubber layer and a 230 μm thick HTV (high-temperature vulcanized) silicone rubber layer provided in this order, and its pressure roller was comprised of a mandrel made of a 5 mm thick aluminum material, having on its outer surface a 2 mm thick RTV silicone rubber layer, a 50 μm thick fluorine rubber layer and a 230 μm thick HTV silicone rubber layer provided in this order.

Fixing temperature was set at 160° C., and fixing speed at 90 mm/sec, where dimethyl silicone oil was applied to the fixing roller to carry out fixing.

To measure the coloring power $D_{0.5}$ of the cyan color toner, an external fixing assembly having the same roller construction as the above was prepared, and images adjusted to have a cyan color toner quantity (M/S) of 0.50 $mg/cm^2$ on the transfer medium were fixed to form cyan color images with a gloss of 15%. Then, their image density was measured using a color reflection densitometer X-RITE 404A, manufactured by X-Rite Co. As a result, the $D_{0.5}$ was 1.40. The measurement of $D_{0.5}$ may not necessarily be limited to the above roller construction and the above fixing conditions, and is not necessarily required to use the external fixing assembly.

Images were reproduced in an environment of normal temperature and normal humidity (23° C., 60% RH) and under conditions of a contrast potential of 300 V. As a result, images had color tones with excellent chroma and were clear. Even in a running test on as many as 60,000 copy sheets, cyan images free of fog and faithful to original images were obtained. In the full-color copying machine, the cyan color toner showed a good transport performance, the density of the cyan color toner was detectable in a good state, and also the image density was stable.

Good cyan color images were also obtained in an environment of low temperature and low humidity (15° C., 10% RH) and an environment of high temperature and high humidity (32.5° C., 85% RH), showing a superior environmental stability.

Example 2

| | |
|---|---|
| Polyester resin obtained by condensation of propoxylated bisphenol-A with fumaric acid (Tm: 95° C.) | 58.3 parts |
| Magenta pigment paste of C.I. Pigment Red 122 (pigment solid content: 25% by weight; water content: 75% by weight) | 100 parts |

The magenta pigment paste used was one having never been in the step of being formed into powder after its preparation.

Using the above materials, magenta pigment-containing polyester resin particles were obtained in the same manner as in Example 1.

| | |
|---|---|
| Magenta pigment-containing polyester resin particles (magenta pigment content: 30% by weight) | 20 parts |
| Polyester resin set out above (Tm: 95° C.) | 84 parts |
| Negative charge control agent (a chromium complex) | 4 parts |

Using the above materials, a magenta color toner was obtained in the same manner as in Example 1. The particle size distribution of the magenta color toner obtained and the particle size distribution of the magenta pigment particles contained in the magenta color toner particles are shown in Table 1.

In the same manner as in Example 1, the above magenta color toner and the hydrophobic fine titanium oxide particles were mixed to obtain a magenta color toner with a degree of agglomeration of 12%, which was then blended with the resin-coated magnetic ferrite carrier to produce a two-component type developer. Image reproduction was also tested in the same manner as in Example 1. Results obtained are shown in Table 2. Even in a running test on as many as 30,000 copy sheets, image density was stable, showing a superior highlight reproduction, and OHP images had a good transparency.

Example 3

| | |
|---|---|
| Polyester resin obtained by condensation of propoxylated bisphenol-A with fumaric acid (Tm: 95° C.) | 80 parts |
| Yellow pigment paste of C.I. Pigment | 100 parts |

-continued

| | |
|---|---|
| Yellow 17 (pigment solid content: 20% by weight; water content: 80% by weight) | |

The yellow pigment paste used was one having never been in the step of being formed into powder after its preparation.

Using the above materials, yellow pigment-containing polyester resin particles were obtained in the same manner as in Example 1.

| | |
|---|---|
| Yellow pigment-containing polyester resin particles (yellow pigment content: 20% by weight) | 20 parts |
| Polyester resin set out above (Tm: 95° C.) | 84 parts |
| Negative charge control agent (a chromium complex) | 4 parts |

Using the above materials, a yellow color toner was obtained in the same manner as in Example 1. The particle size distribution of the yellow color toner obtained and the particle size distribution of the yellow pigment particles contained in the yellow color toner particles ape shown in Table 1.

In the same manner as in Example 1, the above yellow color toner and the hydrophobic fine titanium oxide particles were mixed to obtain a yellow color toner with a degree of agglomeration of 12%, which was then blended with the resin-coated magnetic ferrite carrier to produce a two-component type developer. Image reproduction was also tested in the same manner as in Example 1. Results obtained are shown in Table 2. Even in a running test on as many as 30,000 copy sheets, image density was stable, showing a superior highlight reproduction, and OHP images had a good transparency.

Example 4

The two-component type developer containing the cyan color toner prepared in Example 1, the two-component type developer containing the magenta color toner prepared in Example 2, and the two-component type developer containing the yellow color toner prepared in Example 3 were put into a full-color copying machine, and image reproduction was tested while successively supplying the respective color toners. In the full-color images thus obtained, the color tones of an original copy were faithfully reproduced, and a high image quality was maintained even in a running test on as many as 10,000 copy sheets.

Color tone reproduction of green, blue and red was also in a good state, and color tones were reproducible in a wide range. Also when the full-color images were formed on OHP films, they showed good light transmission properties.

Comparative Example 1

A cyan color toner with a weight average particle diameter of 8.5 μm was obtained in the same manner as in Example 1 except that the conditions for pulverization and classification were changed. The particle size distribution of the cyan color toner obtained and the particle size distribution of the cyan pigment particles contained in the cyan color toner particles are shown in Table 1.

In the same manner as in Example 1, 100 parts of the above cyan color toner and 1 part of the hydrophobic fine titanium oxide particles were mixed to obtain a cyan color toner with a degree of agglomeration of 4%. Next, 6 parts of the cyan color toner was blended with 94 parts of the resin-coated magnetic ferrite carrier to produce a two-component type developer. Image reproduction was also tested in the same manner as in Example 1. Results obtained are shown in Table 2. Compared with the cyan color toner of Example 1, the cyan color toner of Comparative Example 1 showed an inferior highlight reproduction.

Comparative Example 2

A cyan color toner with a weight average particle diameter of 3.9 μm was obtained in the same manner as in Example 1 except that the conditions for pulverization and classification were changed. The particle size distribution of the cyan color toner obtained and the particle size distribution of the cyan pigment particles contained in the cyan color toner particles are shown in Table 1.

In the same manner as in Example 1, 100 parts of the above cyan color toner and 1 part of the hydrophobic fine titanium oxide particles were mixed to obtain a cyan color toner with a degree of agglomeration of 39%. Next, 6 parts of the cyan color toner was blended with 94 parts of the resin-coated magnetic ferrite carrier to produce a two-component type developer. Image reproduction was also tested in the same manner as in Example 1. Results obtained are shown in Table 2. Compared with the cyan color toner of Example 1, this color toner showed a lower image density, caused fog and gave an inferior image quality.

Comparative Example 3

| | |
|---|---|
| Polyester resin obtained by condensation of propoxylated bisphenol-A with fumaric acid (Tm: 95° C.) | 100 parts |
| Cyan pigment powder of C.I. Pigment Blue 15:3 | 5 parts |
| Negative charge control agent (a chromium complex) | 4 parts |

The above materials were premixed using a Henschel mixer, and then the mixture was melt-kneaded using a twin-screw extruder at a temperature of 120° C., followed by the same procedure as in Example 1 to obtain a cyan color toner having a weight average particle diameter of 6.0 μm. The particle size distribution of the cyan color toner thus obtained is shown in Table 1. The cyan pigment particles in the cyan color toner particles had a number average particle diameter of 0.75 μm, and cyan pigment particles with a particle diameter of from 0.1 to 0.5 μm were present in a content of 19.8% by number and cyan pigment particles with a particle diameter of 0.8 μm or larger in a content of 44.6% by number.

The cyan color toner obtained and the same hydrophobic fine titanium oxide particles as used in Example 1 were mixed to obtain a cyan color toner with a degree of agglomeration of 26%, which was then blended with the same resin-coated magnetic ferrite carrier as used in Example 1 to produce a two-component type developer. Image reproduction was also tested in the same manner as in Example 1. The image density $D_{0.5}$ was 0.98, and the image density was lower than that in Example 1. Fog also occurred.

As a result of a running test on 10,000 copy sheets, in-machine toner scatter occurred, where the surface of the fixing roller was examined after the running test to find that the toner had adhered to the surface.

Subtractive color mixture was carried out using the two-component type developer containing the cyan color toner of Comparative Example 3 and the two-component type developer containing the yellow color toner of Example 1. As a result, a green color with a poor chroma was produced.

Comparative Example 4

| | |
|---|---|
| Polyester resin obtained by condensation of propoxylated bisphenol-A with fumaric acid (Tm: 95° C.) | 70 parts |
| Cyan pigment powder of C.I. Pigment Blue 15:3 | 30 parts |

The above materials were premixed using a Henschel mixer, and then the mixture was melt-kneaded three times using a three-roll mill. Subsequently, the kneaded product was cooled, and the kneaded product thus cooled was pulverized to obtain cyan pigment-containing polyester resin particles with a particle diameter of 1 mm or less.

| | |
|---|---|
| Cyan pigment-containing polyester resin particles | 30 parts |
| Polyester resin set out above (Tm: 95° C.) | 79 parts |
| Negative charge control agent (a chromium complex) | 4 parts |

Using the above materials, a cyan color toner with weight average particle diameter of 4.9 μm was obtained in the same manner as in Example 1. The particle size distribution of the cyan color toner obtained and the particle size distribution of the cyan pigment particles contained in the cyan color toner particles are shown in Table 1.

In the same manner as in Example 1, the above cyan color toner and the hydrophobic fine titanium oxide particles were mixed to obtain a cyan color toner with a degree of agglomeration of 22%, which was then blended with the resin-coated magnetic ferrite carrier to produce a two-component type developer. Image reproduction was also tested in the same manner as in Example 1. The image density $D_{0.5}$ was 1.82, and coarse images were seen in highlight areas. Fog also occurred. The results are shown in Table 2.

Example 5

A two-component type developer containing a cyan color toner was produced in the same manner as in Example 1 except that the hydrophobic fine titanium oxide particles were replaced with hydrophobic fine silica particles (R-972, available from Nippon Aerosil Co., Ltd.). Image reproduction was also tested in the same manner as in Example 1. Results obtained are shown in Tables 1 and 2.

Example 6

A two-component type developer containing a cyan color toner was produced in the same manner as in Example 1 except that the polyester resin was replaced with a polyester resin obtained by condensation of propoxylated bisphenol-A with terephthalic acid and dodecenylsuccinic acid (Tm: 105° C.). Image reproduction was also tested in the same manner as in Example 1. Results obtained are shown in Tables 1 and 2.

TABLE 1

| | Toner | | | | | | Pigment in toner particles | | | | |
|---|---|---|---|---|---|---|---|---|---|---|---|
| | | | Particle size distribution | | | | Number | Particle size distribution | | Ag- | |
| | | | Particle diameter (μm) | | Particle diameter (μm) | | av. dia- | Particle diameter (μm) | | glom- era- | |
| Color toner | $D_4$* (μm) | | ≦4.00 (% by number) | ≦5.04 | ≧8.00 (% by volume) | ≧10.08 | meter (μm) | 0.1–0.5 (% by number) | ≧0.8 | tion** (%) | $D_{0.5}$*** |
| Example: | | | | | | | | | | | |
| 1 Cyan | 6.0 | | 22.6 | 49.6 | 5.0 | 0.5 | 0.36 | 82.0 | 0.8 | 9 | 1.40 |
| 2 Magenta | 6.1 | | 29.0 | 60.0 | 9.8 | 1.2 | 0.41 | 71.9 | 1.2 | 11 | 1.35 |
| 3 Yellow | 5.8 | | 23.3 | 54.7 | 4.8 | 0.4 | 0.29 | 87.4 | 1.1 | 12 | 1.55 |
| 5 Cyan | 6.0 | | 22.6 | 49.6 | 5.0 | 0.5 | 0.36 | 82.0 | 0.8 | 10 | 1.40 |
| 6 Cyan | 5.0 | | 47.0 | 78.3 | 2.1 | 0 | 0.32 | 79.9 | 0.3 | 11 | 1.47 |
| Comparative Example: | | | | | | | | | | | |
| 1 Cyan | 8.5 | | 4.0 | 14.5 | 52.2 | 12.3 | 0.35 | 80.7 | 0.9 | 4 | 1.20 |
| 2 Cyan | 3.9 | | 81.3 | 92.4 | 0.9 | 0 | 0.34 | 81.6 | 0.5 | 39 | 1.52 |
| 3 Cyan | 6.0 | | 26.4 | 56.4 | 6.2 | 0.9 | 0.75 | 19.8 | 44.6 | 26 | 0.98 |
| 4 Cyan | 4.9 | | 49.5 | 82.5 | 0.3 | 0 | 0.62 | 49.5 | 13.5 | 22 | 1.82 |

*Weight average particle diameter
**Degree of agglomeration of toner mixed with external additive
***Image density where M/S is 0.50 mg/cm$^2$

TABLE 2

| | Image reproduction test results | | | |
|---|---|---|---|---|
| | Image density (23° C., 60% RH) | Highlight reproduction | Solid image uniformity | Fog |
| Example: | | | | |
| 1 | 1.65–1.80 | Excellent | Excellent | None |
| 2 | 1.60–1.70 | Excellent | Excellent | None |
| 3 | 1.70–1.85 | Excellent | Excellent | None |
| 4 | — | Excellent | Excellent | None |
| 5 | 1.65–1.80 | Good | Good | None |
| 6 | 1.65–1.80 | Excellent | Good | None |
| Comparative Example: | | | | |
| 1 | 1.70–1.80 | Poor | Excellent | None |
| 2 | 1.10–1.25 | Poor | Poor | Occur |
| 3 | 1.20–1.30 | Average | Average | Occur |
| 4 | 1.70–1.90 | Poor | Good | None |

What is claimed is:

1. A color toner for developing an electrostatic image, comprising a binder resin and a colorant, wherein;

said color toner has a weight average particle diameter of from 3 μm to 7 μm; contains from 10% to 70% by number of color toner particles with a particle diameter of 4.00 μm or smaller, not less than 40% by number of color toner particles with a particle diameter of 5.04 μm or smaller, from 2% to 20% by volume of color toner particles with a particle diameter of 8.00 μm or larger, and not more than 6% by volume of color toner particles with a particle diameter of 10.08 μm or larger; and has such a coloring power that an image having been fixed on a transfer medium has an image density ($D_{0.5}$) of from 1.0 to 1.8 when an unfixed color toner on the transfer medium is in a quantity (M/S) of 0.50 mg/cm$^2$.

2. The color toner according to claim 1, wherein said color toner contains the colorant in an amount of from 0.5 part by weight to 12 parts by weight based on 100 parts by weight of the binder resin.

3. The color toner according to claim 1, wherein said colorant has a number average particle diameter of 0.7 μm or smaller, and contains not less than 60% by number of colorant particles with a particle diameter of from 0.1 μm to 0.5 μm and not more than 10% by number of colorant particles with a particle diameter of 0.8 μm or larger.

4. The color toner according to claim 1, wherein said color toner has such a coloring power that an image having been fixed on a transfer medium has an image density ($D_{0.5}$) of from 1.2 to 1.7 when an unfixed color toner on the transfer medium is in a quantity (M/S) of 0.50 mg/cm$^2$.

5. The color toner according to claim 1, wherein the weight average particle diameter ($D_4$) and image density ($D_{0.5}$) of said color toner satisfies the condition of;

$$(16-D_4)/10 \leqq D_{0.5} \leqq (23-D_4)/10.$$

6. The color toner according to claim 1, wherein said color toner has fine titanium oxide particles having an average particle diameter of from 0.01 μm to 0.2 μm and a hydrophobicity of from 20% to 98%.

7. The color toner according to claim 6, wherein said fine titanium oxide particles has been treated with a coupling agent.

8. The color toner according to claim 1, wherein said color toner has a degree of agglomeration of from 2% to 25%.

9. The color toner according to claim 1, wherein said color toner comprises color toner particles prepared by a process comprising the steps of kneading a pigment paste comprising from 5% to 50% by weight of a color pigment and from 95% to 50% by weight of a liquid dispersion medium, together with a binder resin, separating the liquid dispersion medium and dispersing the color pigment in the binder resin to obtain a color-pigment-containing kneaded product, and further kneading the resulting color-pigment-containing kneaded product together with a binder resin.

10. A process for producing a color toner, comprising the steps of kneading a pigment paste comprising from 5% to 50% by weight of a color pigment and from 95% to 50% by weight of a liquid dispersion medium, together with a binder resin, separating the liquid dispersion medium and dispersing the color pigment in the binder resin to obtain a color-pigment-containing kneaded product, further kneading the resulting color-pigment-containing kneaded product together with a binder resin to obtain a kneaded product, cooling the kneaded product followed by pulverization to obtain a pulverized product, and classifying the pulverized product to produce a color toner having a weight average particle diameter of from 3 μm to 7 μm; containing from 10% to 70% by number of color toner particles with a particle diameter of 4.00 μm or smaller, not less than 40% by number of color toner particles with a particle diameter of 5.04 μm or smaller, from 2% to 20% by volume of color toner particles with a particle diameter of 8.00 μm or larger, and not more than 6% by volume of color toner particles with a particle diameter of 10.08 μm or larger; and having such a coloring power that an image having been fixed on a transfer medium has an image density ($D_{0.5}$) of from 1.0 to 1.8 when an unfixed color toner on the transfer medium is in a quantity (M/S) of 0.50 mg/cm$^2$.

11. The process according to claim 10, wherein said pigment paste and said binder resin are kneaded in an open system while heating.

12. The process according to claim 10, wherein said liquid dispersion medium is an aqueous medium.

* * * * *

UNITED STATES PATENT AND TRADEMARK OFFICE

CERTIFICATE OF CORRECTION

PATENT NO. : 5,437,949

DATED : August 1, 1995

INVENTOR(S) : Makoto Kanbayashi, et al

It is certified that error appears in the above-indentified patent and that said Letters Patent is hereby corrected as shown below:

COLUMN 2

Line 63, "poop" should read --poor--.

COLUMN 3

Line 10, "more many" should read --many more--; and

Line 19, "compensate" should read --compensate for--.

COLUMN 5

Line 26, "mope" should read --more--.

COLUMN 6

Line 32, "contain" should read --contains--;

Line 33, "ers" should read --er--; and

Line 65, "mope" should read --more--.

COLUMN 7

Line 8, "$1.2 \leq D_{0.5} \leq 1.5$" should read --$1.2 \leq D_{0.5} \leq 1.7$--; and Line 42, "took" should read --taken--.

UNITED STATES PATENT AND TRADEMARK OFFICE

CERTIFICATE OF CORRECTION

PATENT NO. : 5,437,949

DATED : August 1, 1995

INVENTOR(S) : Makoto Kanbayashi et al

It is certified that error appears in the above-indentified patent and that said Letters Patent is hereby corrected as shown below:

COLUMN 12

Line 4, "group." should read --group--;

Line 52, "a" should be deleted; and

Line 61, "ape" should read --are--.

COLUMN 13

Line 17, "to,obtain" should read --to obtain--.

COLUMN 14

Line 1, "mope" should read --more--.

COLUMN 15

Line 47, "ultrasonic." should read --ultrasonic--.

COLUMN 17

Line 2, "21.5V" should read --21.7V--.

COLUMN 18

Line 18, "example," should read --for example,--.

COLUMN 19

Line 23, "areas:" should read --area:--.

UNITED STATES PATENT AND TRADEMARK OFFICE

CERTIFICATE OF CORRECTION

PATENT NO. : 5,437,949

DATED : August 1, 1995

INVENTOR(S) : Makoto Kanbayashi, et al

It is certified that error appears in the above-indentified patent and that said Letters Patent is hereby corrected as shown below:

COLUMN 21

Line 23, "ape" should read --are--.

COLUMN 24

Line 63, "wherein;" should read --wherein:--.

COLUMN 25

Line 30, "of;" should read --of:--; and

Line 39, "has" should read --have--.

Signed and Sealed this

Fourteenth Day of November, 1995

Bruce Lehman

*Attest:*

BRUCE LEHMAN

*Attesting Officer*

*Commissioner of Patents and Trademarks*